US011323799B2

(12) United States Patent
Tsuchihashi et al.

(10) Patent No.: US 11,323,799 B2
(45) Date of Patent: May 3, 2022

(54) SUPPORTER AND ELECTROACOUSTIC TRANSDUCER DEVICE

(71) Applicant: YAMAHA CORPORATION, Hamamatsu (JP)

(72) Inventors: Yu Tsuchihashi, Hamamatsu (JP); Satoshi Gougi, Hamamatsu (JP); Atsushi Hattori, Yasu (JP); Kazuhiko Nishizawa, Hamamatsu (JP); Akira Miki, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 0 days.

(21) Appl. No.: 17/146,682

(22) Filed: Jan. 12, 2021

(65) Prior Publication Data

US 2021/0136486 A1 May 6, 2021

Related U.S. Application Data

(63) Continuation of application No. PCT/JP2019/027407, filed on Jul. 10, 2019.

(30) Foreign Application Priority Data

Jul. 17, 2018 (JP) ..... JP2018-134023

(51) Int. Cl.
*H04R 1/28* (2006.01)
*H04R 1/02* (2006.01)

(52) U.S. Cl.
CPC ..... *H04R 1/2896* (2013.01); *H04R 1/025* (2013.01); *H04R 1/026* (2013.01)

(58) Field of Classification Search
CPC ..... H04R 1/2896; H04R 1/025; H04R 1/026
(Continued)

(56) References Cited

U.S. PATENT DOCUMENTS

2014/0131134 A1 5/2014 Kobayashi
2016/0227312 A1 8/2016 Nakaishi
2017/0034617 A1* 2/2017 Smith ..... H04R 1/08

FOREIGN PATENT DOCUMENTS

JP H79506 Y2 3/1995
JP 2007096653 A 4/2007
(Continued)

OTHER PUBLICATIONS

International Preliminary Report on Patentability issued in Intl. Appln. No. PCT/JP2019/027407 dated Jan. 28, 2021. English translation provided.

(Continued)

*Primary Examiner* — Sean H Nguyen
(74) *Attorney, Agent, or Firm* — Rossi, Kimms & McDowell LLP

(57) ABSTRACT

A supporter for use in an electroacoustic transducer device including a housing and an electroacoustic transducer mounted to the housing using the supporter, the supporter including: a truncated conical shaped body including: a first portion configured to be held in contact with the electroacoustic transducer at a first position; and a second portion configured to be held in contact with the housing at a second position, wherein the second position is disposed spaced from the first position along an axial direction of an axis of the truncated conical shaped body.

19 Claims, 7 Drawing Sheets

(58) Field of Classification Search
USPC ..... 381/336
See application file for complete search history.

(56) References Cited

FOREIGN PATENT DOCUMENTS

| | | |
|---|---|---|
| JP | 2014068342 A | 4/2014 |
| WO | 2013005578 A1 | 1/2013 |

OTHER PUBLICATIONS

International Search Report issued in Intl. Appln. No. PCT/JP2019/027407 dated Sep. 3, 2019. English translation provided.
Written Opinion issued in Intl. Appln. No. PCT/JP2019/027407 dated Sep. 3, 2019. English translation provided.
Office Action issued in Japanese Appln. No. 2018-134023 dated Oct. 11, 2021. English machine translation provided.

* cited by examiner

SUPPORTER AND ELECTROACOUSTIC TRANSDUCER DEVICE

CROSS REFERENCE TO RELATED APPLICATION

The present application is a continuation application of International Application No. PCT/JP2019/027407, filed on Jul. 10, 2019, which claims priority to Japanese Patent Application No. 2018-134023, filed on Jul. 17, 2018. The contents of these applications are incorporated by reference in their entirety.

BACKGROUND

Technical Field

The following disclosure relates to an electroacoustic transducer device, such as a microphone or a speaker, configured to convert between a sound and an electric signal representing a waveform of the sound, and relates to a supporter used in the electroacoustic transducer device.

Description of Related Art

Noise may be generated in an electroacoustic transducer device if a vibration is transmitted to an electroacoustic transducer that converts between a sound and an electric signal representing a waveform of the sound. The electric signal will be hereinafter referred to as "sound signal" where appropriate. One example of the noise is handling noise generated in a handheld microphone. The handling noise is generated when a vibration is transmitted from a hand holding the microphone to a housing of the microphone and then to the electroacoustic transducer supported in the housing, and a sound signal containing a vibration component is thereby output.

To reduce the handling noise, a structure for supporting the electroacoustic transducer with respect to the housing has been proposed. In this structure, an insulator (hereinafter referred to as "supporter" where appropriate) formed of an elastic material such as rubber is interposed between the electroacoustic transducer and the housing. For instance, Patent Document 1 (Japanese Examined Utility Model Registration Application Publication No. 7-9506) discloses using, as the supporter, a rubber ring in which a plurality of holes (or grooves) are formed in a circumferential direction of the rubber ring.

SUMMARY

In a case where the handling noise is reduced using the supporter, the handling noise is more effectively reduced with an increase in an area of the supporter in which the supporter undergoes shear deformation. This is because a resonance frequency of a vibration generated in a head portion of the microphone is shifted toward a lower frequency side with an increase in the area that undergoes shear deformation, so that the handling noise can be shifted toward a lower frequency side that is lower than a lower limit of a band used for the microphone. In the rubber ring indicated above, the area that undergoes shear deformation may be increased by increasing a ring width in plan view while decreasing the thickness of the rubber ring. It is, however, difficult for the rubber ring incorporated in the handheld microphone for vibration damping purpose to have an increased ring width due to limitation in size in the radial direction. It is noted that noise may be generated in a stationary microphone as experienced in the handheld microphone, due to the vibration transmitted to the electroacoustic transducer via the housing of the electroacoustic transducer device. Further, such noise may be generated not only in microphones but also in speakers.

Accordingly, one aspect of the present disclosure is directed to a technique of enhancing an effect of reducing the handling noise without involving an increase in size in the radial direction of the supporter that supports the electroacoustic transducer with respect to the housing of the electroacoustic transducer device.

In one aspect of the present disclosure, a supporter for use in an electroacoustic transducer device including a housing and an electroacoustic transducer mounted to the housing using the supporter includes: a truncated conical shaped body including: a first portion configured to be held in contact with the electroacoustic transducer at a first position; and a second portion configured to be held in contact with the housing at a second position, wherein the second position is disposed spaced from the first position along an axial direction of an axis of the truncated conical shaped body.

In another aspect of the present disclosure, an electroacoustic transducer device includes: a housing; an electroacoustic transducer; and a supporter mounting the electroacoustic transducer to the housing. The supporter including a truncated conical shaped body includes: a first portion held in contact with the electroacoustic transducer at a first position; and a second portion held in contact with the housing at a second position, wherein the second position is disposed spaced from the first position along an axial direction of an axis of the truncated conical shaped body.

BRIEF DESCRIPTION OF THE DRAWINGS

The objects, features, advantages, and technical and industrial significance of the present disclosure will be better understood by reading the following detailed description of embodiments, when considered in connection with the accompanying drawings, in which.

DETAILED DESCRIPTION OF THE EMBODIMENTS

There will be hereinafter described embodiments of the present disclosure.

A. First Embodiment

Figure 1:
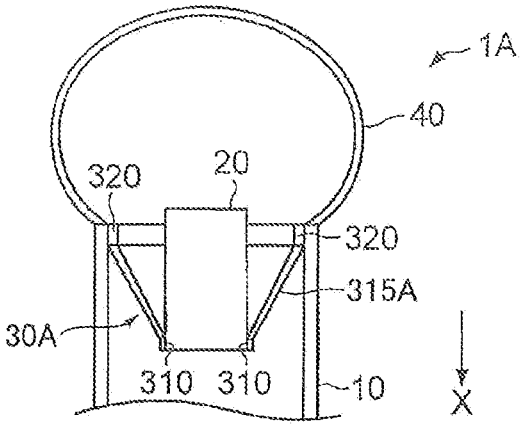
FIG. 1 is a partial cross-sectional view of a microphone 1A according to a first embodiment.

FIG. 1 is a partial cross-sectional view of a microphone 1A according to a first embodiment. The microphone 1A is a handheld microphone having a substantially cylindrical shape. FIG. 1 is a cross-sectional view of a head portion of the microphone 1A, taken along a plane including a central axis of the microphone 1A (i.e., a central axis of the cylindrical shape). As illustrated in FIG. 1, the microphone 1A includes: a housing 10; a microphone capsule 20; a supporter 30A supporting the microphone capsule 20 with respect to the housing 10; and a windshield 40 covering the microphone capsule 20.

The housing 10 is a cylindrical member formed of resin or metal. When using the microphone 1A, a user holds the housing 10 such that the windshield 40 faces vertically upward. The windshield 40 is formed of metal mesh, for instance. The windshield 40 allows sounds having arrived from the outside to pass through the windshield 40 to an inner space defined by the windshield 40 and the housing 10. As illustrated in FIG. 1, the microphone capsule 20 is supported by the supporter 30A (as one example of "supporter") in the inner space.

The microphone capsule 20 is a substantially cylindrical member having a diameter smaller than that of the housing 10. The microphone capsule 20 includes: a diaphragm formed of synthetic resin or metal; and an electroacoustic transducer configured to convert a vibration of the diaphragm caused by sounds having arrived from the outside, to sound signals and output the sound signals. In FIG. 1, illustration of the diaphragm and the electroacoustic transducer is omitted. The electroacoustic transducer may have a configuration similar to that of an electroacoustic transducer of conventional microphones. Specifically, the electroacoustic transducer includes: a voice coil connected to the diaphragm; and magnets and a yoke that generate a magnetic field interlinked with the voice coil.

The supporter 30A is a cylindrical member having an inverted truncated conical shape and formed of an elastic material such as fluororubber. That is, the supporter 30A is formed in a hollow, inverted truncated conical shape having a circumferential wall with a predetermined thickness. The supporter 30A has opposite end faces orthogonal to a central axis of the supporter 30A (i.e., a rotation axis of the inverted truncated conical shape). In the following description, one of the end faces having a radius smaller than that of the other of the end faces will be referred to as "first end face", and the other will be referred to as "second end face". The supporter 30A further has a circumferential wall 315A connecting the first end face and the second end face.

As described above, the microphone 1A of the present embodiment is held by the user such that the windshield 40 faces vertically upward. In this state, the supporter 30A is attached to the housing 10 such that the first end face is oriented in a vertically downward direction, namely, in a direction indicated by an arrow X in FIG. 1. The first end face of the supporter 30A has an inside diameter that is substantially equal to an outside diameter of the microphone capsule 20. An inner circumferential portion of the first end face is held in contact with the microphone capsule 20 and functions as a first portion 310 that supports the microphone capsule 20. The second end of the supporter 30A has an outside diameter that is substantially equal to an inside diameter of the housing 10. An outer circumferential portion of the second end face functions as a second portion 320 that is held in contact with the housing 10. The second portion 320 is held in contact with an inner circumferential surface of the housing 10, whereby the supporter 30A is supported with respect to the housing 10. In the microphone 1A of the present embodiment, the first portion 310 and the second portion 320 are located at mutually different height levels in the axial direction of the supporter 30A. In a state in which the microphone 1A is held by the user such that the windshield 40 and the microphone capsule 20 face vertically upward and the central axis of the supporter 30A extends in parallel with the vertical direction, the first portion 310 is located at a height level lower than that of the second portion 320. The circumferential wall 315A extends from the first portion 310 to the second portion 320 and is shaped such that an inside diameter of the circumferential wall 315A increases in a direction from the first portion 310 toward the second portion 320.

An area in the supporter 30A at which the supporter 30A undergoes shear deformation is the circumferential wall 315A. By increasing the size of the supporter 30A in the central axis direction, namely, by increasing the height of the truncated conical shape, the area that undergoes shear deformation can be increased without involving an increase in size in the radial direction. Thus, as compared with a configuration in which the electroacoustic transducer is supported by a flat, ring-shaped supporter, the supporter 30A of the present embodiment ensures an enhanced effect of reducing the handling noise without increasing the size of the supporter in the radial direction.

In the first embodiment, the first portion 310 is located at a height level lower than that of the second portion 320 in a state in which the central axis of the supporter 30A extends in parallel with the vertical direction (i.e., the X direction in FIG. 1). The configuration may be modified such that the supporter 30A is attached upside down to the housing 10 and the second portion 320 is located at a height level lower than that of the first portion 310. This modified configuration can also enhance the effect of reducing the handling noise without increasing the size of the supporter in the radial direction, as compared with the configuration in which the electroacoustic transducer is supported by the flat, ring-shaped supporter. It is noted, however, that the position of the center of gravity of the microphone capsule 20 (the electroacoustic transducer) with respect to the housing 10 is lower and the stability of the microphone 1A is higher in the configuration of the embodiment in which the first portion 310 is located at a height level lower than that of the second portion 320, as compared with the modified configuration in which the second portion 320 is located at a height level lower than that of the first portion 310. Thus, the configuration according to the present embodiment is preferable.

B. Second Embodiment

Figure 2:
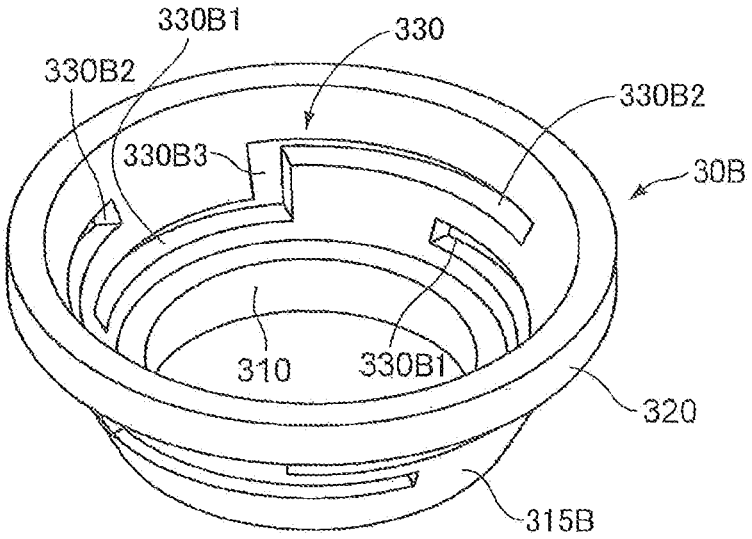
FIG. 2 is a perspective view of a supporter 30B according to a second embodiment.
Figure 3:
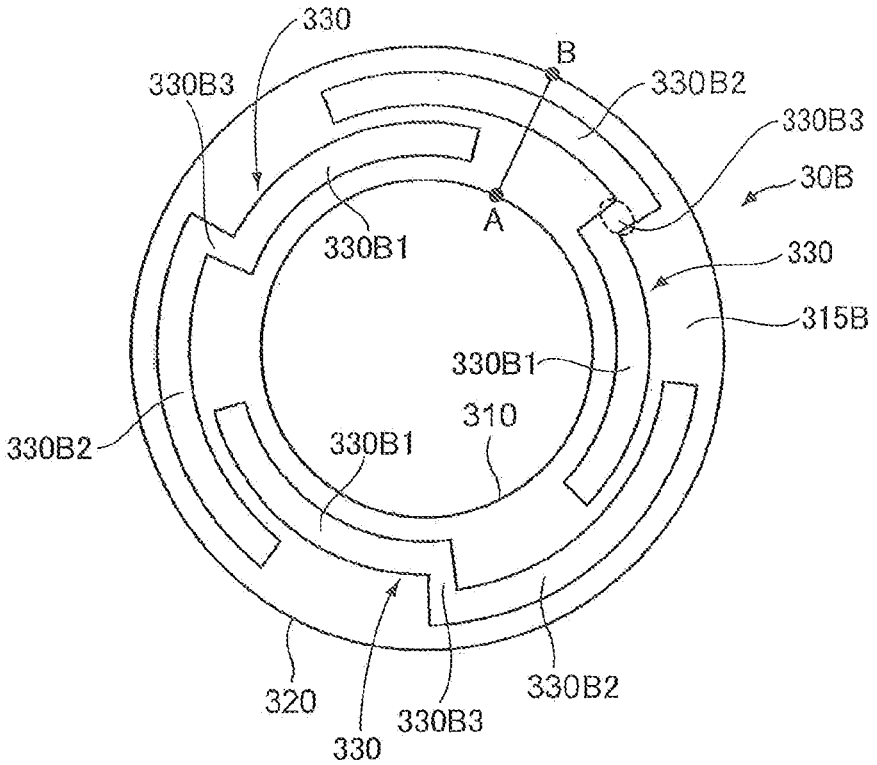
FIG. 3 is a plan view of the supporter 30B according to the second embodiment.

FIG. 2 is a perspective view illustrating an external appearance of a supporter 30B according to a second embodiment, and FIG. 3 is a plan view of the supporter 30B viewed on a second-end-face side of the supporter 30B. As illustrated in FIGS. 2 and 3, the supporter 30B differs from the supporter 30A of the first embodiment in that the supporter 30B has holes (slots or cutouts) 330 formed on a circumferential wall 315B. Specifically, three holes 330 each extending in the circumferential direction of the circumferential wall 315B are formed on the circumferential wall 315B such that a planar shape of the supporter 30B viewed in the central axis direction has three-fold rotation symmetry (i.e., 120-degree rotation symmetry) about the central axis. The three holes 330 are formed so as to be shifted relative to each other in the circumferential direction of the circumferential wall 315B and so as to partly overlap each other in the circumferential direction. That is, a range in the circumferential direction of the circumferential wall 315B over which one of the three holes 330 is formed partly overlaps each of ranges in the circumferential direction over which are respectively formed two of the three holes 330 that are adjacent to the one of the three holes 330 in the circumferential direction. Thus, the three holes 330 are formed such that a line segment AB drawn in the radial direction in a planar shape of the circumferential wall 315B when the supporter 30B is viewed in the central axis direction extends inevitably across at least one of the three holes 330. In other words, the three holes 330 are formed such that, in the planar shape of the circumferential wall 315B when the supporter 30B is viewed in the central axis direction, the line segment AB, which indicates the shortest path on the circumferential wall 315B from a point on the first end face (i.e., the first portion 310) to a point on the second end face (i.e., the second portion 320), extends inevitably across at least one of the three holes 330 at any position in the circumferential direction of the circumferential wall 315B.

Each of the three holes 330 includes: a first-diameter hole section 330B1 (as one example of "first formed portion") extending in the circumferential direction of the circumferential wall 315B; a second-diameter hole section 330B2 (as one example of "second formed portion") extending in the circumferential direction of the circumferential wall 315B; and a cutout 330B. The first-diameter hole section 330B1 is a part of the hole 330. The first-diameter hole section 330B is formed at a first-diameter region of the circumferential wall 315B having a first diameter larger than the inside diameter of the first portion 310 (the first end face). The three first-diameter hole sections 330B1 are disposed so as to be equally spaced apart from each other in the circumferential direction of the circumferential wall 315B. The second-diameter hole section 330B2 is a part of the hole 330. The second-diameter hole section 330B is formed at a second-diameter region of the circumferential wall 315B having a second diameter larger than the first diameter. The three second-diameter hole sections 330B2 are disposed so as to be equally spaced apart from each other in the circumferential direction of the circumferential wall 315B. The cutout 330B3 is a part of the hole 330. The cutout 330B3 is disposed between one end of the first-diameter hole section 330B1 and one end of the second-diameter hole section 330B2 to connect the one end of the first-diameter hole section 330B1 and the one end of the second-diameter hole section 330B2. As illustrated in FIG. 3, the three first-diameter hole sections 330B1 and the three second-diameter hole sections 330B2 are shifted relative to each other in the circumferential direction and partly overlap relative to each other in the circumferential direction. That is, a range in the circumferential direction of the circumferential wall 315B over which one of the three first-diameter hole sections 330B1 is formed partly overlaps each of ranges in the circumferential direction of the circumferential wall 315B over which are respectively formed two of the three second-diameter hole sections 330B2 that are adjacent to the one of the first-diameter hole sections 330B in the circumferential direction. In this configuration, the three first-diameter hole sections 330B1 and the three second-diameter hole sections 330B2 are formed such that, in the planar shape of the circumferential wall 315B when the supporter 30B is viewed in the central axis direction, the line segment AB drawn in the radial direction extends inevitably across a) one of the first-diameter hole sections 330B1, b) one of the second-diameter hole sections 330B2 or c) one of the first-diameter hole sections 330B1 and one of the second-diameter hole sections 330B2. In other words, the three first-diameter hole sections 330B1 and the three second-diameter hole sections 330B2 are formed such that, in the above-indicated planar shape of the circumferential wall 315B, the line segment AB that indicates the shortest path from the point on the first end face (i.e., the first portion 310) to the point on the second end face (i.e., the second portion 320) extends inevitably across a) one of the three the first-diameter hole sections 330B1, b) one of the three second-diameter hole sections 330B2 or c) one of the three the first-diameter hole sections 330B1 and one of the three second-diameter hole sections 330B2, at any position in the circumferential direction of the circumferential wall 315B. In other words, the plurality of slots are arranged so that a line extending in a radial direction of the truncated conical shaped body, in a view taken along a planar elevational view, intersects at least one of the plurality of slots. In the present embodiment, the supporter 30 is constructed as illustrated in FIGS. 2 and 3 for the following reasons.

By forming the holes on the circumferential wall of the supporter having the inverted truncated conical shape illustrated in the first embodiment, the circumferential wall of the supporter more easily undergoes shear deformation, as compared with the first embodiment. The applicant of the present disclosure has conducted experiments for examining a relationship between: the number, the size, and the position, of the holes formed on the circumferential wall of the supporter having the inverted truncated conical shape; and frequency response of the supporter.

Figure 4:
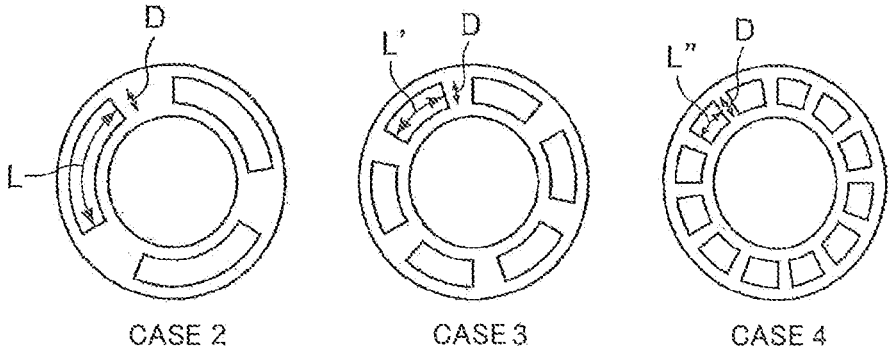
FIG. 4 is a view for explaining frequency response measurement experiments conducted on supporters by the applicant of the present disclosure.
Figure 5:
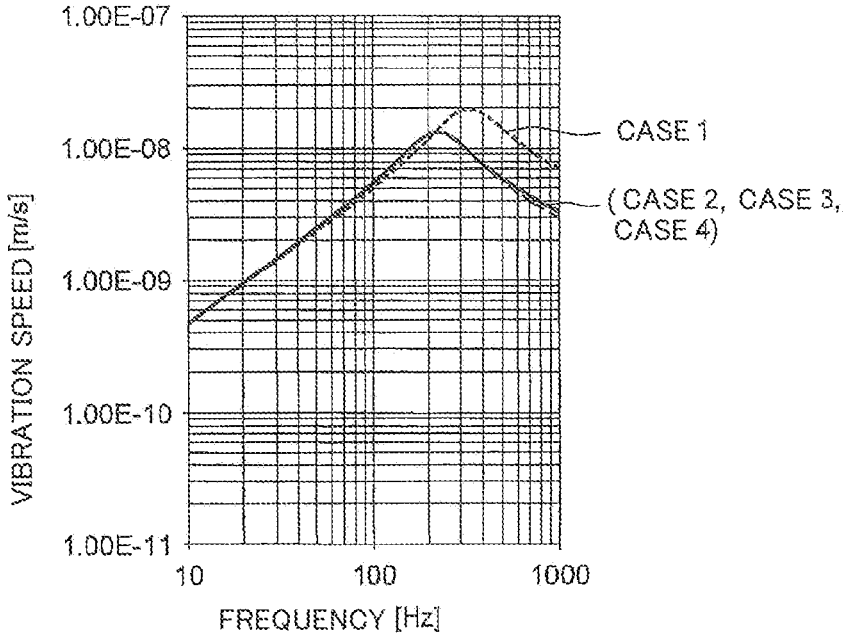
FIG. 5 is a view for explaining frequency response measurement experiments conducted on supporters by the applicant.

Specifically, the applicant measured the frequency response for: a supporter (case 1) not having holes on the circumferential wall like the supporter 30A of the first embodiment; and supporters (cases 2-4 illustrated in FIG. 4) having the holes on the circumferential wall. As illustrated in FIG. 4, the supporter of case 2 has three holes disposed in rotation symmetry, the supporter of case 3 has six holes disposed in rotation symmetry, and the supporter of case 4 has twelve holes disposed in rotation symmetry. The holes of the supporters of cases 2-4 have the same length D in the radial direction. Each hole of the supporter of case 3 has a length L' in the circumferential direction that is half a length L in the circumferential direction of each hole of the supporter of case 2. Each hole of the supporter of case 4 has a length L" in the circumferential direction that is half the length L' in the circumferential direction of each hole of the supporter of the case 3. In the supporters of cases 2-4, the holes are thus arranged for allowing an area of a portion of the circumferential wall at which the holes are not formed to be the same among the supporters of cases 2-4. Further, the holes are disposed in rotation symmetry in each of the supporters of cases 2-4 for preventing the microphone capsule 20 from being inclined when supported by the supporter. FIG. 5 indicates measurement results of the frequency response in the supporters of cases 1-4. It is to be understood from the measurement results of FIG. 5 that the resonance frequency of the vibration generated in the head portion of the microphone is shifted toward a low frequency side, namely, shear deformation more easily occurs, owing to provision of the holes on the circumferential wall of the supporter. It is to be further understood that the amount of shift in frequency does not depend on the number of holes if the total area of the holes is the same among the supporters.

Figure 6:
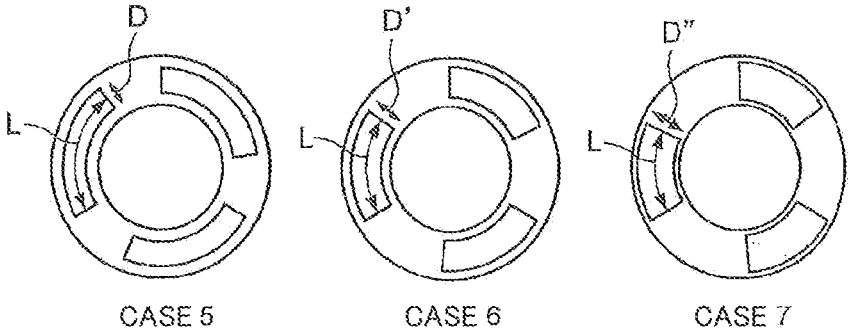
FIG. 6 is a view for explaining frequency response measurement experiments conducted on supporters by the applicant.
Figure 7:
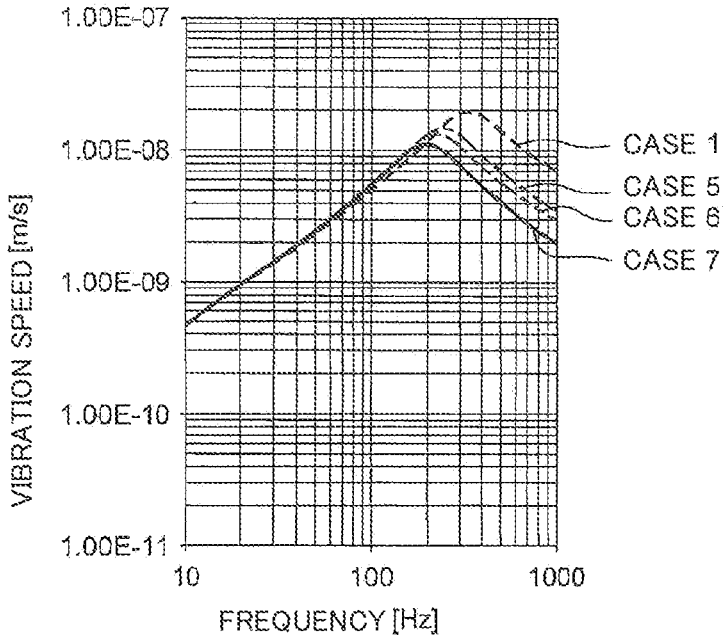
FIG. 7 is a view for explaining frequency response measurement experiments conducted on supporters by the applicant.

The applicant of the present disclosure measured frequency response for supporters of cases 5-7 illustrated in FIG. 6. In each of the supporters of cases 5-7, three holes are disposed in rotation symmetry. The holes of the supporters of cases 5-7 have the same length L in the circumferential direction. However, the length D of the hole in the radial direction is made different among the supports of cases 5-7, i.e., cases 5-7: D<D'<D" as illustrated in FIG. 6. FIG. 7 indicates measurement results. It is to be understood from the measurement results of FIG. 7 that the resonance frequency of the vibration generated in the head portion of the microphone is shifted toward a lower frequency side with an increase in the length of the hole in the radial direction.

Figure 8:
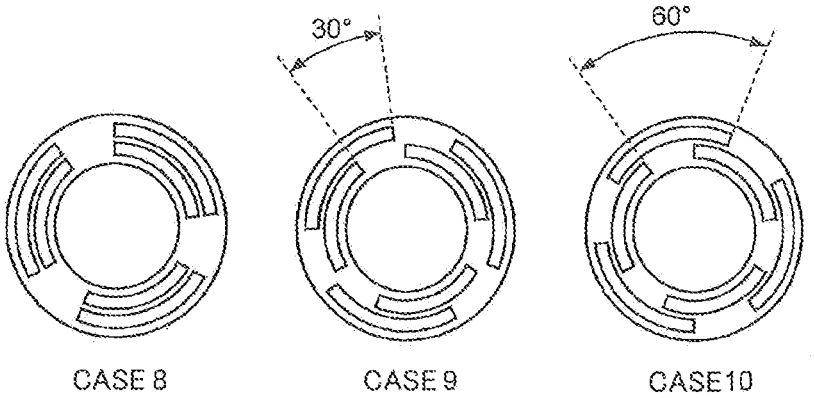
FIG. 8 is a view for explaining frequency response measurement experiments conducted on supporters by the applicant.
Figure 9:
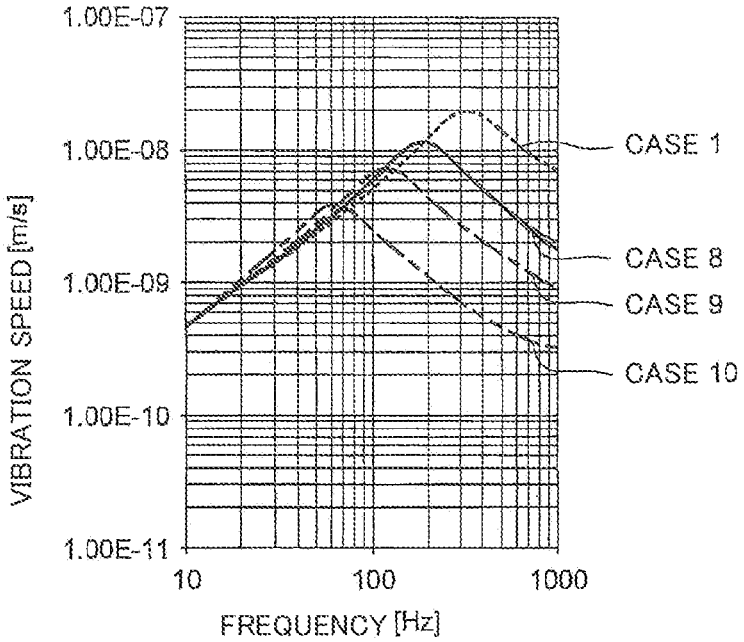
FIG. 9 is a view for explaining frequency response measurement experiments conducted on supporters by the applicant.

As illustrated in FIG. 8, the applicant of the present disclosure measured frequency response for supporters (cases 8-10). In the supporter of case 8, three pairs of holes are disposed in rotation symmetry, two holes in each pair being arranged in the radial direction and extending in the circumferential direction. In the supporter of case 9, the two holes arranged in the radial direction are shifted relative to each other in the circumferential direction by 30 degrees. In the supporter of case 10, the two holes arranged in the radial direction are shifted relative to each other in the circumferential direction by 60 degrees. FIG. 9 indicates measurement results. It is to be understood from the measurement results of FIG. 9 that the resonance frequency of the vibration generated in the head portion of the microphone is shifted toward a lower frequency side with an increase in an amount by which the holes arranged in the radial direction are shifted relative to each other in the circumferential direction, i.e., a shift amount. Here, by shifting the positional relationship of the holes arranged in the radial direction, the resonance frequency of the vibration generated in the head portion of the microphone is shifted toward a lower frequency side for the following reasons.

Figure 10:
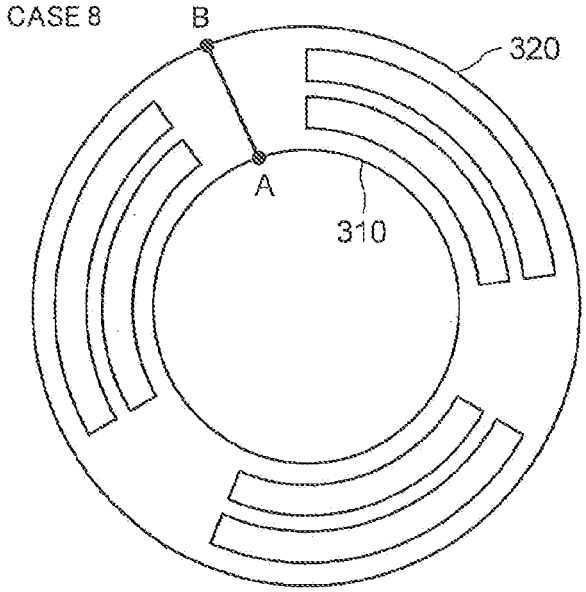
FIG. 10 is a view for explaining the shortest distance from a microphone capsule 20 to a housing 10 along a circumferential wall of a supporter of a case 8.
Figure 11:
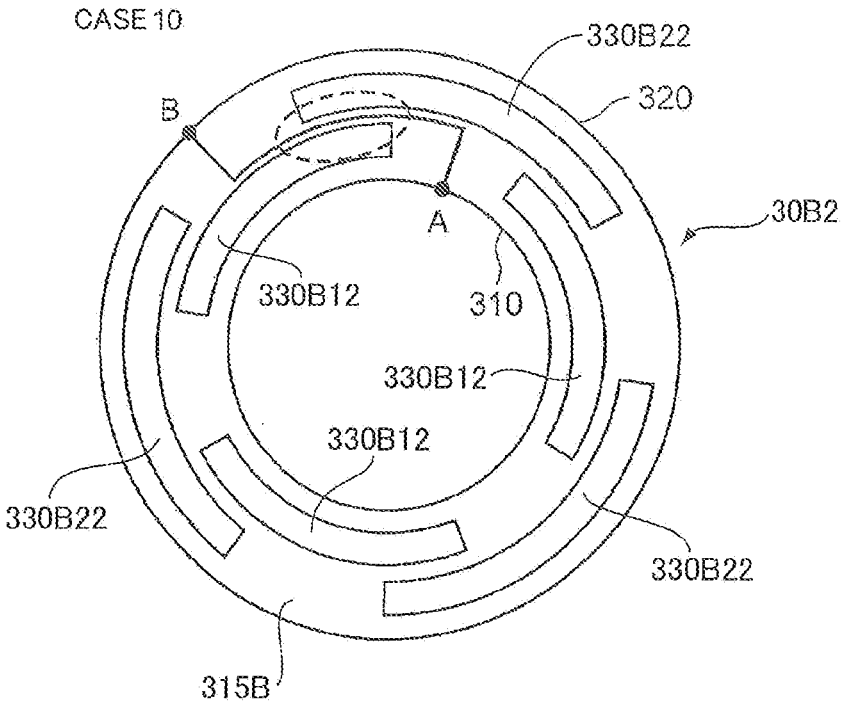
FIG. 11 is a view for explaining the shortest distance from a microphone capsule 20 to a housing 10 along a circumferential wall of a supporter of a case 10.

As for the supporter of case 8 illustrated in FIG. 8, the shortest path AB (i.e., the shortest path that does not pass across any holes 330) along the circumferential wall from the microphone capsule 20 to the housing 10 is equal to a line segment drawn in the radial direction along the circumferential wall, as illustrated in FIG. 10. As for the supporter of case 10 illustrated in FIG. 8, a line segment drawn in the radial direction extends inevitably across at least one of the plurality of holes. That is, in the supporter of case 10 illustrated in FIG. 8, the shortest path AB (i.e., the shortest path that does not pass across any holes 330) along the circumferential wall from the microphone capsule 20 to the housing 10 is larger, as compared with that of the supporter of case 8. Thus, the supporter of case 10 includes, along the shortest path AB (i.e., the shortest path that does not pass across any holes 330), a narrow width portion in which the width is locally small, as indicated by a portion enclosed by dashed line in FIG. 11. Owing to the narrow width portion, shear deformation is allowed to occur easily in the circumferential direction in the supporter of case 10, as compared with the supporter of case 8, so that the resonance frequency of the vibration generated in the head portion of the microphone is shifted toward a low frequency side. As illustrated in FIG. 11, a supporter 30B2 of the present embodiment corresponding to the supporter of case 10 includes three first holes 330B12 (each as one example of "first formed portion") extending in the circumferential direction of the circumferential wall 315B and three second holes 330B22 (each as one example of "second formed portion") extending in the circumferential direction of the circumferential wall 315B. Like the first-diameter hole section 330B1 of FIG. 3, each of the three first holes 330B12 is formed at the first-diameter region of the circumferential wall 315B having the first diameter larger than the inside diameter of the first portion 310 (i.e., the first end face). The three first holes 330B12 are disposed so as to be equally spaced apart from each other in the circumferential direction of the circumferential wall 315B. Like the second-diameter hole section 330B2 of FIG. 3, the three second holes 330B22 are formed at the second-diameter region of the circumferential wall 315B having the second diameter larger than the first diameter. The three second holes 330B22 are disposed so as to be spaced apart from each other in the circumferential direction of the circumferential wall 315B. One of the three first holes 330B12 and a corresponding one of the three second holes 330B22 are shifted relative to each other in the circumferential direction of the circumferential wall 315B. The three first holes 330B12 and the three second holes 330B22 are shifted relative to each other in the circumferential direction and partly overlap relative to each other in the circumferential direction. That is, a range in the circumferential direction of the circumferential wall 315B over which one of the three first holes 330B12 is formed partly overlaps each of ranges in the circumferential direction of the circumferential wall 315B over which are respectively formed two of the three second holes 330B22 that are adjacent to the one of the three first holes 330B12 in the circumferential direction. In this configuration, the three first holes 330B12 and the three second holes 330B22 are formed such that, in the planar shape of the circumferential wall 315B when the supporter 30B2 is viewed in the central axis, a line segment AB drawn in the radial direction (similar to that in FIG. 3) extends inevitably across a) one of the three first holes 330B12, b) one of the three second holes 330B22 or c) one of the three first holes 330B12 and one of the three second holes 330B22. In other words, the three first holes 330B12 and the three second holes 330B22 are formed such that, in the above-indicated planar shape of the circumferential wall 315B, a line segment (similar to that in FIG. 3) that indicates the shortest path from a point on the first end face (i.e., the first portion 310) to a point on the second end face (i.e., the second portion 320) extends inevitably across a) one of the three first holes 330B12, b) one of the three second holes 330B22 or c) one of the three first holes 330B12 and one of the three second holes 330B22, at any position in the circumferential direction of the circumferential wall 315B.

The amount by which the first hole 330B12 and the second hole 330B22 arranged in the radial direction are shifted relative to each other is not limited to 60 degrees. The shift amount may be determined to allow the shortest path along the circumferential wall from the microphone capsule 20 to the housing 10 to be as long as possible. In other words, the shift amount may be determined to allow the line segment drawn in the radial direction in the planar shape of the supporter to extend inevitably across at least one of the plurality of holes formed on the circumferential wall of the supporter.

Figure 12:
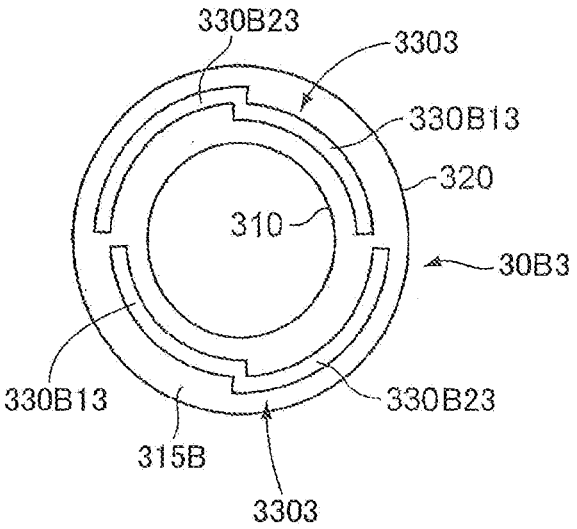
FIG. 12 is a view illustrating one example of a planar shape of a supporter having two-fold rotation symmetry; and and FIG. 13 is a cross-sectional view of a microphone 1C according to a third embodiment.

In view of the above observation, as illustrated in FIG. 3, the supporter 30B according to the present embodiment includes three pairs of the holes 330B1, 330B2 disposed in rotation symmetry, the two holes 330B1, 330B2 in each pair being arranged in the radial direction and extending in the circumferential direction. In addition, the supporter 30B according to the present embodiment includes the cutouts 330B3 (one of which is indicated by a portion enclosed by dashed line in FIG. 3). Each cutout 330B3 connects corresponding holes 330B1, 330B2 arranged in the radial direction so as to allow the two holes 330B1, 330B2 to function as one hole. The cutout 330B3 is one example of "connecting portion". The cutouts 330B3 allow shear deformation in the circumferential direction to occur as easily as possible. It is considered that shear deformation in the circumferential direction occurs more easily in a supporter 30B3 illustrated in FIG. 12 in which two holes 3303, each including a first-diameter hole section 330B13 and a second-diameter hole section 330B23, are disposed such that a planar shape of the supporter 30B3 viewed in the axial direction has two-fold rotation symmetry about the axis. However, the stability with which the microphone capsule 20 is supported is lower in the supporter 30B3 of FIG. 12 than in the supporter 30B of FIGS. 2 and 3. This is because the supporter 30B of FIGS. 2 and 3 can support the microphone capsule 20 at three points in accordance with the symmetry of the supporter 30B as a whole (three-fold rotation symmetry) whereas the supporter 30B3 of FIG. 12 supports the microphone capsule 20 at two points. It is thus preferable to employ three-fold rotation symmetry illustrated in FIG. 2 and FIG. 3.

As explained above, as compared with the conventional configuration in which the electroacoustic transducer is supported with respect to the housing of the electroacoustic transducer device by the flat, ring-shaped supporter, the supporter in the present embodiment enhances the effect of reducing the noise without increasing the size of the supporter in the radial direction. Moreover, the supporter in the present embodiment ensures a higher effect of reducing the noise than the supporter of the first embodiment.

C. Third Embodiment

Figure 13:
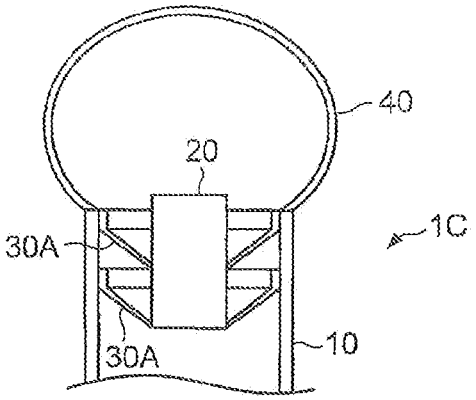

In the first embodiment, the microphone 1 has only one supporter 30A having the inverted truncated conical shape. The microphone capsule 20 may be supported by a plurality of the supporters 30A. FIG. 13 is a cross-sectional view of a head portion of a microphone 1C in which the microphone capsule 20 is supported by the two supporters 30A. By supporting the microphone capsule 20 by the plurality of the supporters 30A, the stability with which the microphone capsule 20 is supported is higher in the third embodiment than in the first embodiment or the second embodiment in which the microphone capsule 20 is supported by the single supporter having the inverted truncated conical shape.

In a case where the microphone capsule 20 is supported by a plurality of supporters having rotation symmetry similar to that of the supporter 30B of the second embodiment, rotation symmetry need not be the same among the plurality of supporters. Further, even in a case where the plurality of supporters have the same rotation symmetry, the planar shapes of the supporters need not overlap when viewed in the central axis direction. For instance, two supporters each having two-fold rotation symmetry (i.e., line symmetry) may be disposed such that symmetry axes (axes of line symmetry) of the respective two supporters are orthogonal to each other to support the microphone capsule 20. This configuration ensures the stability in supporting the microphone capsule 20 while enabling the two supporters to more easily undergo shear deformation, as compared with the configuration in which is used only one supporter having three-fold rotation symmetry.

D. Modifications

There have been explained above the first through third embodiments of the present disclosure. The embodiments illustrated above may be modified as follows. (1) In the second embodiment, the plurality of holes 330 are disposed such that the planar shape of the supporter 30B viewed in the axial direction has three-fold rotation symmetry about the axis. The plurality of holes 330 may be disposed such that the planar shape has four- or more-fold rotation symmetry. In short, the plurality holes 330 are disposed in N- or more-fold rotation symmetry. Here, N is a natural number greater than or equal to 3. This configuration enables the supporter to more easily undergo local shear deformation while enabling the electroacoustic transducer to be supported without being inclined, by keeping the symmetry of the supporter as a whole at N-fold rotation symmetry about the axis of the inverted truncated conical shape. The supporter 30B of the second embodiment has the planar shape illustrated in FIG. 3. The supporter 30B may have the planar shape of any of the supporters of cases 2-10 illustrated above. This is because, as long as the holes that extend in the circumferential direction are formed on the circumferential wall, it is considered that shear deformation in the circumferential direction occurs more easily, as compared with the supporter 30A of the first embodiment.

(2) In place of the holes 330 of the second embodiment, there may be formed third portions each having a thickness smaller than that of other portion of the supporter 30B. This configuration also enables the circumferential wall of the supporter having the inverted truncated conical shape to easily undergo shear deformation, as compared with a configuration in which the supporter has neither the holes 330 (as described in the first embodiment) nor the third portions each as the portion having a thickness smaller than that of other portion of the supporter. Thus, the effect of reducing the noise can be enhanced. The supporter 30B of the second embodiment has the hollow, inverted truncated conical shape. Instead, the supporter 30B of the second embodiment may be shaped like a disc, for instance. The disc-like supporter may have the holes 330 or the third portions 330 similar to those in the second embodiment.

(3) The supporter in each embodiment is formed of an elastic material such as fluororubber. Thus, the supporter has elasticity owing to material. The supporter may be formed of resin. This is because the area of the supporter that undergoes shear deformation can be ensured owing to shape if the supporter has the holes as in the second embodiment or the supporter has the third portions in place of the holes as in the modification (1).

(4) Though the principle of the present disclosure is applied to the handheld microphone in the illustrated embodiments, it may be applicable to stationary microphones because the sound signal that includes the noise arising from the vibration transmitted via the housing is output from the electroacoustic transducer in the stationary microphones. The principle of the present disclosure may be applied to speakers, thereby making it possible to reduce noise emitted due to transmission of the vibration to the electroacoustic transducer via the housing of the speakers. In short, the vibration is prevented from being transmitted to the electroacoustic transducer via the housing and the noise due to the vibration is thereby prevented from being generated in the electroacoustic transducer device including the housing and the electroacoustic transducer, by providing the supporter formed in the inverted truncated conical shape and including the first portion held in contact with the electroacoustic transducer and the second portion held in contact with the housing, the first portion and the second portion being positioned at mutually different height levels in the axial direction.

What is claimed is:

1. A supporter for use in an electroacoustic transducer device including a housing and an electroacoustic transducer included in a microphone and configured to pickup sound and output a sound signal, mounted to the housing using the supporter, the supporter comprising:

a truncated conical shaped body including:

a first portion configured to be held in contact with the electroacoustic transducer at a first position; and a second portion configured to be held in contact with the housing at a second position, wherein the second position is disposed spaced from the first position along an axial direction of an axis of the truncated conical shaped body.

2. The supporter according to claim 1, wherein the first portion is located at a height level lower than that of the second portion, in a state where the axis is extending vertically.

3. The supporter according to claim 1, wherein the truncated conical shaped body further includes at least one slot disposed between the first portion and the second portion.

4. The supporter according to claim 3, wherein:

the truncated conical shaped body includes a circumferential wall connecting the first portion and the second portion, and the at least one slot extends along a circumferential direction of the circumferential wall.

5. The supporter according to claim 4, wherein the circumferential wall includes a plurality of slots, including the at least one slot, that are symmetrically arranged around the axis.

6. The supporter according to claim 4, wherein:

the first portion is a first end face configured to be held in contact with the electroacoustic transducer at an inner circumferential portion of the first end face, and the second portion is a second end face configured to be held in contact with the housing at an outer circumferential portion of the second end face.

7. The supporter according to claim 6, wherein the at least one slot is disposed so that a line extending along a shortest path from the first end face to the second end face intersects the at least one slot.

8. The supporter according to claim 3, wherein:

the truncated conical shaped body includes a circumferential wall connecting the first portion and the second portion, the circumferential wall includes a plurality of slots, including the at least one slot, disposed spaced apart from each other in the circumferential direction of the circumferential wall, and the plurality of slots each include:

a first slot portion disposed at a first-diameter region of the circumferential wall along a first diameter that is larger than an inside diameter of the first end face and smaller than an outside diameter of the second end face; and a second slot portion disposed at a second-diameter region of the circumferential wall along a second diameter that is larger than the first diameter and smaller than the outside diameter of the second end face.

9. The supporter according to claim 8, wherein the first slot portion and the second slot portion of each of the plurality of slots are shifted relative to each other along the axial direction.

10. The supporter according to claim 8, wherein each of the plurality of slots include a connecting portion connecting the first slot portion and the second slot portion.

11. The supporter according to claim 8, wherein the plurality of slots are arranged so that the first slot portion of one slot, among the plurality of slots, and the second slot portion of a neighboring slot, among the plurality of slots, that neighbors the one slot, partly overlap in the circumferential direction.

12. The supporter according to claim 1, wherein the truncated conical shaped body is made of an elastic material.

13. An electroacoustic transducer device comprising:

a housing;

an electroacoustic transducer included in a microphone and configured to pickup sound and output a sound signal; and a supporter mounting the electroacoustic transducer to the housing, the supporter comprising a truncated conical shaped body including:

a first portion held in contact with the electroacoustic transducer at a first position; and a second portion held in contact with the housing at a second position, wherein the second position is disposed spaced from the first position along an axial direction of an axis of the truncated conical shaped body.

14. The electroacoustic transducer device according to claim 13, further comprising a plurality of supporters each corresponding to the supporter.

15. The electroacoustic transducer device according to claim 13, wherein the truncated conical shaped body further includes at least one slot disposed between the first portion and the second portion.

16. The electroacoustic transducer device according to claim 15, wherein:

the truncated conical shaped body includes a circumferential wall connecting the first portion and the second portion, and the at least one slot extends along a circumferential direction of the circumferential wall.

17. The electroacoustic transducer device according to claim 16, wherein:

the first portion is a first end face held in contact with the electroacoustic transducer at an inner circumferential portion of the first end face, the second portion is a second end face held in contact with the housing at an outer circumferential portion of the second end face, and the at least one slot is disposed so that a line drawn along a shortest path from the first end face to the second end face intersects the at least one slot.

18. The electroacoustic transducer device according to claim 15, wherein:

the truncated conical shaped body includes a circumferential wall connecting the first portion and the second portion, the circumferential wall includes a plurality of slots, including the at least one slot, disposed spaced apart from each other in the circumferential direction of the circumferential wall, and the plurality of slots each include:

a first slot portion disposed at a first-diameter region of the circumferential wall along a first diameter that is larger than an inside diameter of the first end face and smaller than an outside diameter of the second end face; and a second slot portion disposed at a second-diameter region of the circumferential wall along a second diameter that is larger than the first diameter and smaller than the outside diameter of the second end face.

19. The electroacoustic transducer device according to claim 18, wherein the plurality of slots are arranged so that the first slot portion of one slot, among the plurality of slots, and the second slot portion of a neighboring slot, among the plurality of slots, that neighbors the one slot, partly overlap in the circumferential direction.

* * * * *